US010247451B2

(12) United States Patent
Qiu et al.

(10) Patent No.: US 10,247,451 B2
(45) Date of Patent: Apr. 2, 2019

(54) CRYOGENIC REGENERATOR AND CRYOGENIC REFRIGERATOR

(71) Applicants: ZHEJIANG UNIVERSITY, Hangzhou, Zhejiang (CN); SUMITOMO HEAVY INDUSTRIES, LTD., Tokyo (JP)

(72) Inventors: Limin Qiu, Hangzhou (CN); Kai Fang, Hangzhou (CN); Xiao Jiang, Hangzhou (CN); Zhihua Gan, Hangzhou (CN); Zui Ri, Nishitokyo (JP)

(73) Assignees: ZHEJIANG UNIVERSITY, Hangzhou (CN); SUMITOMO HEAVY INDUSTRIES, LTD., Tokyo (JP)

( * ) Notice: Subject to any disclaimer, the term of this patent is extended or adjusted under 35 U.S.C. 154(b) by 111 days.

(21) Appl. No.: 15/335,653

(22) Filed: Oct. 27, 2016

(65) Prior Publication Data

US 2017/0045274 A1 Feb. 16, 2017

Related U.S. Application Data

(63) Continuation of application No. PCT/CN2015/077632, filed on Apr. 28, 2015.

(30) Foreign Application Priority Data

Apr. 29, 2014 (CN) ..... 2014 1 0178718

(51) Int. Cl.
*F25B 9/14* (2006.01)

(52) U.S. Cl.
CPC ..... *F25B 9/145* (2013.01); *F25B 2309/003* (2013.01); *F25B 2309/1407* (2013.01);
(Continued)

(58) Field of Classification Search
CPC ..... F25B 2309/003; F25B 2309/1415; F25B 2309/1416; F25B 9/145
(Continued)

(56) References Cited

U.S. PATENT DOCUMENTS 2,492,788 A * 12/1949 Wolcott ..... F25J 5/002 165/10
4,209,061 A * 6/1980 Schwemin ..... F02G 1/057 165/10
(Continued)

FOREIGN PATENT DOCUMENTS

CN 101561196 A 10/2009
CN 101832675 A 9/2010
(Continued)

OTHER PUBLICATIONS

English translation of JP10115472A, provided by Espacenet. Mar. 2018.*

*Primary Examiner* — Tareq Alosh
(74) *Attorney, Agent, or Firm* — HEA Law PLLC

(57) ABSTRACT

In a cryogenic regenerator including a regenerator tube, a partitioning tube, whose tube wall is perforated by uniformly distributed through-holes, inside of which regenerator packing is provided, and having rib rings wrapped peripherally around its outer wall, is arranged coaxially inside the regenerator tube, with a buffer cavity between the regenerator-tube inner wall and the partitioning-tube outer wall. In a pulse-tube refrigerator including the regenerator and a gas reservoir, the regenerator, thanks to the designing of its reservoir and through-holes, draws in radial flows such that the form of heat exchange in the same regenerator cross-section goes from being simple thermal conduction to being heat exchange in which heat convection is coupled with thermal conduction, enhancing radial heat transfer and enabling rapid equilibration of temperature gradients along
(Continued)

the regenerator periphery, and, by effectively keeping non-uniformity phenomena inside the regenerator under control, making improved refrigerator efficiency possible.

6 Claims, 3 Drawing Sheets

(52) U.S. Cl.
CPC ..... *F25B 2309/1415* (2013.01); *F25B 2309/1416* (2013.01); *F25B 2309/1423* (2013.01)

(58) Field of Classification Search
USPC ..... 165/4
See application file for complete search history.

(56) References Cited

U.S. PATENT DOCUMENTS 5,398,511 A * 3/1995 Inaguchi ..... F25B 9/14 62/6
6,347,453 B1 * 2/2002 Mitchell ..... B21C 37/154 29/506

FOREIGN PATENT DOCUMENTS

| | | | | | |
|---|---|---|---|---|---|
| CN | 104019587 | A | | 9/2014 | |
| CN | 203881010 | U | | 10/2014 | |
| JP | H05-223374 | A | | 8/1993 | |
| JP | H08-303895 | A | | 11/1996 | |
| JP | H09-269156 | A | | 10/1997 | |
| JP | 10115472 | A | * | 5/1998 | ..... F25B 9/145 |

* cited by examiner

CRYOGENIC REGENERATOR AND CRYOGENIC REFRIGERATOR

INCORPORATION BY REFERENCE

Priority is claimed to Chinese Patent Application No. 201410178718.X, filed Apr. 29, 2014, and International Patent Application No. PCT/CN2015/077632, the entire content of each of which is incorporated herein by reference.

BACKGROUND

Technical Field

The present invention in certain embodiments relates to the refrigerator industry, and in particular relates to cryogenic regenerators and cryogenic refrigerators.

Description of Related Art

Pulse-tube refrigerators are regenerative refrigerators that gain refrigeration by the principle of temperature decrease due to adiabatic expansion of a gas. Mainstream pulse-tube refrigerators at present are divided according to their drive scheme into two categories, Gifford-McMahon (GM) pulse-tube refrigerators and Stirling pulse-tube refrigerators, wherein according to needs, double-inlet installations may be appended to the GM types and to the Stirling types.

A Stirling pulse-tube refrigerator as illustrated in FIG. 1 includes, in connected order, a compressor, a transport pipe 1, a cooler 2, a regenerator 3, a cold-end heat exchanger 4, a pulse tube 5, a hot-end heat exchanger 6, an inertance tube 7, and a reservoir 8, while a Stirling pulse-tube refrigerator having a double inlet is further provided with, as illustrated in FIG. 2, a gas inlet tube 10 having an inlet valve 9, wherein one end of the inlet tube is connected to the transport pipe, and the other end is connected to the hot-end heat exchanger.

A GM pulse-tube refrigerator as illustrated in FIG. 3 includes, in connected order, a transport pipe 1, a cooler 2, a regenerator 3, a cold-end heat exchanger 4, a pulse tube 5, a hot-end heat exchanger 6, an inertance tube 7, and a reservoir 8; here, the cooler is connected to a high-pressure gas source via a first gas pipe, and connected to a low-pressure gas source via a second gas pipe, with the first gas pipe and the second gas pipe both being provided with an electrically actuated valve, while a GM pulse-tube refrigerator having a double inlet is further provided with, as illustrated in FIG. 4, a gas inlet tube 10 having an inlet valve 9, with one end of the inlet tube being connected to the transport pipe, and the other end being connected to the hot-end heat exchanger.

The working processes of a pulse-tube refrigerator are as follows. When compressed gas from the compressor enters into the refrigerator (with GM types a high-pressure gas source is connected to the refrigerator), the gas, having gone through a prior-stage precooling process in the cooler as well as a precooling process in the regenerator, enters into the pulse tube, where the heat of compression is discharged by the hot-end heat exchanger. When the gas begins to expand and returns to the compressor (with GM types a low-pressure gas source is connected to the refrigerator), the gas adiabatically expands in the pulse tube 5, whereby the temperature drops, and at the same time the refrigeration is transferred by the cold-end heat exchanger 4, with the regenerator being precooled by the remnant refrigeration. Herein, as a core among the components, the regenerator 3 has a critically important impact on the efficiency and refrigerating capability of the refrigerator.

With conventional large-capacity pulse-tube refrigerators, there are problems, originating in the augmentation of the geometric size of the regenerator, unique to large-capacity pulse-tube refrigerators, with the most typical being that of non-uniformity phenomena inside large-diameter regenerators. Non-uniformity phenomena, due to flows in the regenerator interior and to positive heat-conduction feedback, are phenomena in which the heat regenerating efficiency abruptly deteriorates. The mechanism giving rise to non-uniformity phenomena is exceedingly complex, and is one in which linearly streaming flows reciprocate between the cold end and the hot end inside the regenerator, and is characterized by the temperature of the regenerator along its periphery having a pronounced temperature gradient. This in actuality produces a drastic reduction in the effective volume participating in the cooling cycle inside the regenerator, while with the linearly streaming flows, heat energy at the hot end also is introduced into the cold end, increasing losses inside the regenerator and furthermore, producing an abrupt drop in regenerator efficiency. Research has brought to light the fact that regenerators in which non-uniformities are kept under control achieve a cooling capability generated by the refrigerator that is five times that of refrigerators in which non-uniformities are not kept to a minimum. As will be appreciated from this, keeping non-uniformities under control holds critically important significance for large-capacity pulse-tube refrigerators.

Currently, the method of keeping non-uniformities under control is to have increasing the same cross-sectional heat transfer be the expedient, which means inserting high thermal-conductivity packing into the middle stage of the regenerator. For example, Chinese Patent CN1971172 discloses a regenerative heat exchanger of enhanced radial heat conductivity, which includes a regenerator housing and, placed in alternation inside the regenerator housing, perforated metal plates and metal meshes/lead spheres whose heat conductivities differ. However, with this approach, axially directed heat conductivity inside the regenerator increases such that subsequent heat conduction losses in the regenerator also increase. Currently reported regenerators ordinarily must be able to withstand temperature gradients whose temperature differences exceed 220 K over distances of less than 100 mm, on account of which metal packing for increasing the axial heat conductivity has not been the optimal choice for the regenerator.

Large-capacity pulse-tube refrigerators are adopted chiefly in industrial areas such as diverse high-temperature superconductors, and lossless reservoirs for cryogenic fluids, which include superconducting motors, superconducting generators, superconductive current limiters, superconductive leads, and large-scale cryogenic fluid-reservoir tanks. Since they are subject to the limitations of factors including regenerator efficiency, large-capacity pulse-tube refrigerators currently are of overall efficiency that, as before, is not high, thus, higher efficiency regenerators are predisposed to future development.

SUMMARY

In order to resolve the above-discussed problems, the present invention affords a cryogenic regenerator. Effectively keeping non-uniformity phenomena inside the regenerator under control to improve the regenerator efficiency is made possible.

One embodiment affords a cryogenic regenerator including a regenerator tube; a partitioning tube coaxially arranged inside the regenerator tube to leave a buffer cavity between an inner wall of the regenerator tube and an outer wall of the partitioning tube, the partitioning-tube's tube wall being perforated by a plurality of uniformly distributed through-holes; and regenerator packing provided inside the partitioning tube.

DETAILED DESCRIPTION

Figure 1:
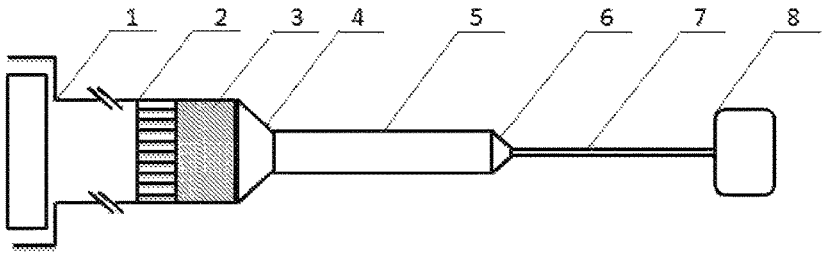
FIG. 1 is a structural schematic diagram of a conventional Stirling-type pulse-tube refrigerator.
Figure 2:
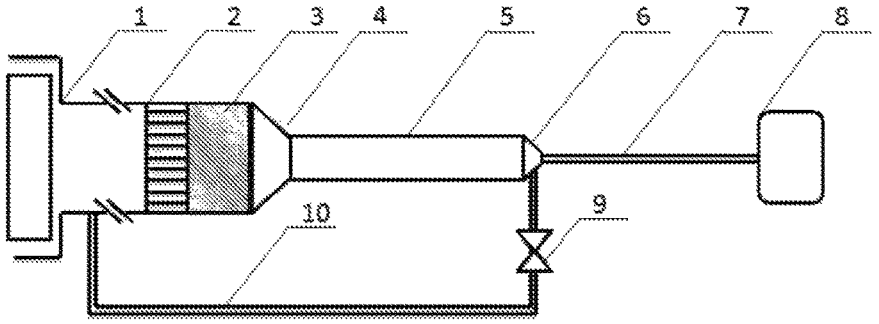
FIG. 2 is a structural schematic diagram of a conventional Stirling-type pulse-tube refrigerator with a bidirectional gas intake arrangement.
Figure 3:
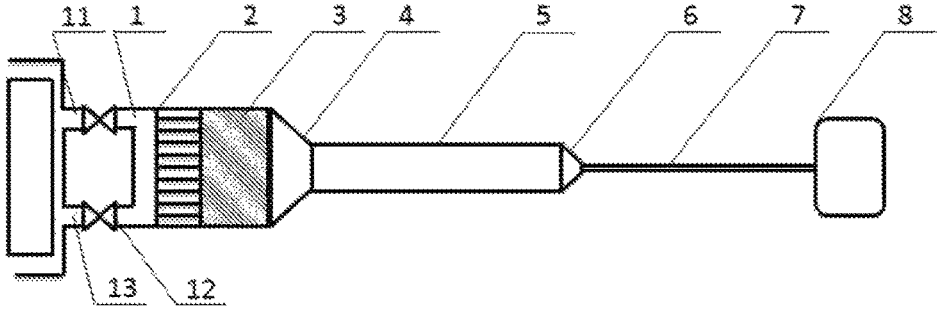
FIG. 3 is a structural schematic diagram of a conventional GM-type pulse-tube refrigerator.
Figure 4:
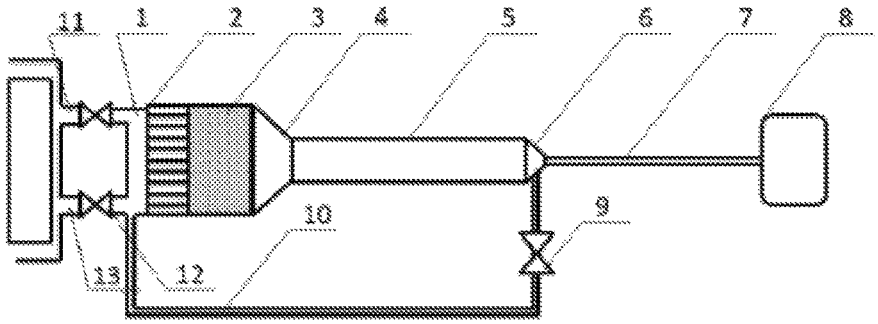
FIG. 4 is a structural schematic diagram of a conventional GM-type pulse-tube refrigerator with a bidirectional gas intake arrangement.

The invention will now be described by reference to the preferred embodiments. This does not intend to limit the scope of the present invention, but to exemplify the invention.

According to one embodiment of the present invention, there is provided a cryogenic regenerator to solve such problems. It is possible to efficiently inhibit the non-uniform phenomenon within the regenerator and to improve the regenerator efficiency.

The one embodiment provides a cryogenic regenerator including a regenerator tube, in which a partitioning tube is coaxially arranged in the regenerator tube, a buffer cavity is provided between an inner wall of the regenerator tube and an outer wall of the partitioning tube, a plurality of through holes is evenly distributed in a pipe wall of the partitioning tube, and a heat regenerating filler is arranged in the partitioning tube.

The partitioning tube is provided with the through holes through which a gas in the partitioning tube is introduced in the buffer cavity. The gas is mixed and heat-exchanged in the buffer cavity, and then introduced into the partitioning tube via the through holes and heat-exchanged with the heat regenerating filler. According to this configuration, the radial flow is introduced such that the heat exchange mode of the same section of the regenerator is switched from pure heat conduction mode to a mode that heat convection is coupled with the heat conduction. Thus it is possible to drastically enhance the radial heat transfer of the regenerator without increasing in the axial heat transfer of the regenerator, to balance the temperature gradient in the circumferential direction of the regenerator more rapidly, to effectively inhibit the non-uniform phenomenon in the refrigerator and to significantly improve the efficiency of the refrigerator, thereby increasing the cooling performance at the low temperature.

A plurality of rib rings wound in the circumferential direction is preferably provided on the outer wall of the partitioning tube.

The rib rings serve as separators, which causes the gas in the buffer cavity not to form the convection between the hot-end and the cold-end. Thus the axial heat transfer loss due to introduction of side flow into the partitioning tube decreases compared with the conventional arrangement of providing a wire net with high heat conductivity.

A gap is preferably provided between the rib ring and the inner wall of the regenerator tube in order to cause the gas to establish the temperature gradient along with an axis line of the partitioning tube.

The gap between the regenerating pipe and the partitioning tube can be connected by any conventional manner, such as welding, screwing or engaging, however, it is preferable that the regenerator tube and the partitioning tube are fixed by a flange at an end.

According to other embodiment of the present invention, there is provided a low-temperature refrigerator including a compressor, a transmission pipe, a cooler, a regenerator, a cold-end heat exchanger, a pulse tube, a hot-end heat exchanger, an inertance tube and a reservoir, which are sequentially connected. The regenerator is the cryogenic regenerator according to the present invention.

It is preferable that the low-temperature refrigerator preferably further includes an air inlet tube having an air intake valve, in which one end of the gas inlet tube is connected to the transmission pipe and the other end thereof is connected to the hot-end heat exchanger.

According to another embodiment of the present invention, there is provided a cooler, a regenerator, a cold-end heat exchanger, a pulse tube, a hot-end heat exchanger, an inertance tube and a reservoir, which are sequentially connected. The cooler includes a first gas pipe connected to a high-pressure gas source and a second gas pipe connected to a low-pressure gas source. Each of the first gas pipe and the second gas pipe has an electrical valve. The regenerator is the cryogenic regenerator according to the present invention.

It is preferable that the low-temperature refrigerator preferably further includes an air inlet tube having an air intake valve, in which one end of the air inlet tube is connected to the first gas pipe and the other end thereof is connected to the hot-end heat exchanger.

The present invention may have the following advantageous effects.

First, by means of the design of the buffer cavity and the through holes, radial flow is introduced, so that the heat exchange mode of the same section of the cryogenic regenerator is switched from pure heat conduction to a mode that heat convection is coupled with the heat conduction, radial heat transfer is drastically enhanced without increasing in the axial heat transfer of the regenerator, the temperature gradient in the circumferential direction of the regenerator can be balanced more rapidly, the non-uniform phenomenon in the refrigerator can be effectively inhibited, and the efficiency of the refrigerator can be significantly improved, thereby increasing the cooling performance at the low temperature.

Moreover, by means of the design of the rib rings engaged in a gap of the regenerator tube, the gas in the buffer cavity does not form the convection between the hot-end and the cold-end. Furthermore, the gas establishes the temperature gradient along with the axis line in the buffer cavity.

Moreover, since the gas has much less heat conductivity than that of the metal, the axial heat transfer of the side flow into the partitioning tube is significantly smaller than the conventional axial heat transfer with the conventional metal net having a high heat conductivity when the temperature difference is the same.

Hereinafter, the mode for carrying out the present invention will be described in detail with reference to the drawings. It is to be noted that the same element is provided with the same numeral in descriptions of the drawings, and a repeated description is omitted as appropriate. Further, a configuration described below is illustrative and is not to restrict the scope of the present invention.

Figure 5:
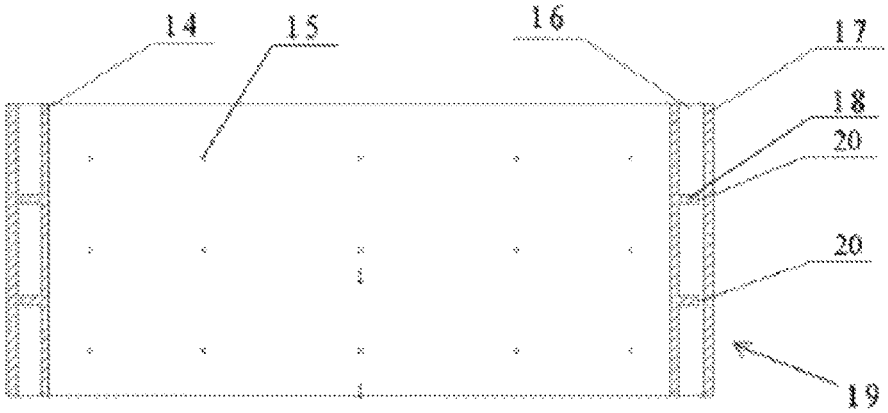
FIG. 5 is a structural partial sectional view of the cryogenic regenerator according to an embodiment of the present invention.

As shown in FIG. 5, in a cryogenic regenerator 19 including a regenerator tube 17, a partitioning tube 14 is coaxially arranged in the regenerator tube. A plurality of through holes 15 is evenly distributed in a pipe wall of the partitioning tube 14. A heat regenerating filler is arranged in the partitioning tube. A plurality of rib rings 18 wound in the circumferential direction is provided on an outer wall of the partitioning tube 14. A buffer cavity 16 is provided between an inner wall of the regenerator tube and the outer wall of the partitioning tube. A gap 20 is provided between the rib rings 18 and the inner wall of the regenerator tube to cause the gas to establish the temperature gradient along with an axial line of the partitioning tube.

The gap between the regenerator tube and the partitioning tube can be connected by any conventional manner, such as welding, screwing or engaging. In this embodiment, an end of the regenerator tube and an end of the partitioning tube are fixed by a flange 21.

Figure 6:
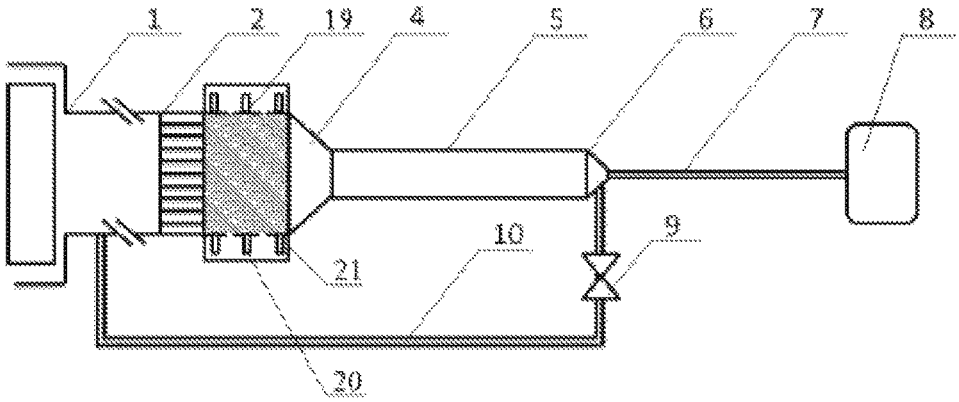
FIG. 6 is a structural schematic diagram of a low-temperature refrigerator according to an embodiment of the present invention.

As shown in FIG. 6, a low-temperature refrigerator includes a compressor, a transmission pipe 1, a cooler 2, the cryogenic regenerator 19, a cold-end heat exchanger 4, a pulse tube 5, a hot-end heat exchanger 6, an inertance tube 7 and a gas reservoir 8, which are sequentially connected. The low-temperature refrigerator further includes gas inlet tube 10 having a gas intake valve 9. One end of the gas inlet tube is connected to the transmission pipe, and the other end thereof is connected to the hot-end heat exchanger.

Figure 7:
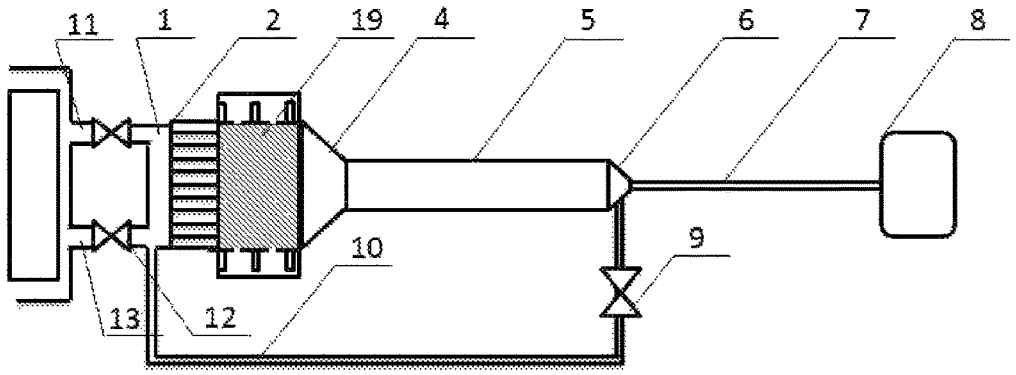
FIG. 7 is a structural schematic diagram of the low-temperature refrigerator according to another embodiment of the present invention.

As shown in FIG. 7, the other low-temperature refrigerator includes a cooler 2, the cryogenic regenerator 19, a cold-end heat exchanger 4, a pulse tube 5, a hot-end heat exchanger 6, an inertance tube 7 and a gas reservoir 8, which are sequentially connected. The cooler includes a first gas pipe 13 connected to a high-pressure gas source and a second gas pipe 11 connected to a low-pressure gas source. Each of the first gas pipe and the second gas pipe has an electrical valve 12. The low-temperature refrigerator further includes a gas inlet tube 10 having a gas intake valve 9. One end of the gas inlet tube is connected to the first gas pipe, and the other end thereof is connected to the hot-end heat exchanger.

The cryogenic regenerator of the present invention has the following advantageous effects. First, by means of the design of the buffer cavity and the through holes, radial flow is introduced, so that the heat exchange mode of the same section of the cryogenic regenerator is switched from pure heat conduction to a mode that heat convection is coupled with the heat conduction, radial heat transfer is drastically enhanced without increasing in the axial heat transfer of the regenerator, the temperature gradient in the circumferential direction of the regenerator can be balanced more rapidly, the non-uniform phenomenon in the refrigerator can be effectively inhibited, and the efficiency of the refrigerator can be significantly improved, thereby increasing the cooling performance at the low temperature. Moreover, by means of the design of the rib rings engaged in a gap of the regenerator tube, the gas in the buffer cavity does not form the convection between the hot-end and the cold-end. Furthermore, the gas establishes the temperature gradient along with the axis line in the buffer cavity.

It should be understood that the invention is not limited to the above-described embodiment, but may be modified into various forms on the basis of the spirit of the invention. Additionally, the modifications are included in the scope of the invention.

What is claimed is:

1. A cryogenic regenerator, comprising:

a regenerator tube;

a partitioning tube coaxially arranged inside of the regenerator tube to leave a buffer cavity predetermined radial separation between an inner wall circumferential surface of the regenerator tube and an outer wall circumferential surface of the partitioning tube, the predetermined radial separation constituting a buffer cavity, and the partitioning-tube's tube wall being perforated by a plurality of uniformly distributed through-holes;

regenerator packing provided inside, as a component distinct from, the partitioning tube; and a plurality of rib rings arranged inside the regenerator tube and wrapped peripherally onto the outer wall circumferential surface of the partitioning tube;

wherein the rib rings, along an outer circumferential surface thereof, are separated from the inner circumferential surface of the regenerator tube by a predetermined gap.

2. The cryogenic regenerator according to claim 1, wherein an axial end of the regenerator tube and an axial end of the partitioning tube are fixed by a flange.

3. A cryogenic refrigerator, comprising:

a compressor, a transport pipe, a cooler, a regenerator, a cold-end heat exchanger, a pulse tube, a hot-end heat exchanger, an inertance tube, and a gas reservoir, connected in that order;

wherein the regenerator is the cryogenic regenerator according to claim 1.

4. The cryogenic refrigerator according to claim 3, further comprising a gas inlet tube provided with an inlet valve, wherein one end of the gas inlet tube is connected to the transport pipe, and the other end thereof is connected to the hot-end heat exchanger.

5. A cryogenic refrigerator, comprising:

a cooler, a regenerator, a cold-end heat exchanger, a pulse tube, a hot-end heat exchanger, an inertance tube, and a gas reservoir, connected in that order, the cooler including a first gas pipe connected to a high-pressure gas source and a second gas pipe connected to a low-pressure gas source, the first gas pipe and the second gas pipe each being provided with an electrically actuated valve, wherein the regenerator is the cryogenic regenerator according to claim 1.

6. The cryogenic refrigerator according to claim 5, further comprising a gas inlet tube provided with an inlet valve, wherein one end of the gas inlet tube is connected to the first gas pipe, and the other end thereof is connected to the hot-end heat exchanger.

* * * * *